US005409447A

United States Patent [19]

Wedge, Jr.

[11] Patent Number: 5,409,447

[45] Date of Patent: Apr. 25, 1995

[54] ORTHOPEDIC ASSEMBLY DEVICE TO FUNCTIONALLY ASSIST A DISABLE HUMAN HAND

[76] Inventor: Roy D. Wedge, Jr., 4408 Crüz Dr., Midland, Mich. 48642

[21] Appl. No.: 133,642

[22] Filed: Oct. 7, 1993

[51] Int. Cl.[6] ..... A61H 1/00

[52] U.S. Cl. ..... 601/40; 602/21; 128/879; 2/161.1; 2/161.6

[58] Field of Search ..... 601/40; 602/21, 22; 2/161.1, 161.4, 161.6, 161.7, 166; 482/47, 49; 623/63–65; 128/879, 880

[56] References Cited

U.S. PATENT DOCUMENTS

| | | | |
|---|---|---|---|
| 3,333,850 | 8/1967 | Miller | 473/60 |
| 3,347,547 | 10/1967 | Hynes | 482/47 |
| 3,903,878 | 9/1975 | Spann | 602/21 |
| 3,944,220 | 3/1976 | Fusano | 482/47 |
| 4,084,267 | 4/1978 | Zadina | 623/63 |
| 4,167,044 | 9/1979 | Girard | 623/64 |
| 4,220,875 | 1/1988 | Latina et al. | 2/161.1 |
| 4,887,616 | 12/1989 | Baijnath | 128/879 |

FOREIGN PATENT DOCUMENTS

| | | | |
|---|---|---|---|
| 296148 | 3/1915 | Germany | 602/21 |
| 931199 | 5/1982 | U.S.S.R. | 482/49 |

*Primary Examiner*—Richard J. Apley
*Assistant Examiner*—Jeanne M. Clark
*Attorney, Agent, or Firm*—Robert J. Rhead

[57] ABSTRACT

This invention relates to human hand splinting and/or orthopedic assembly devises used to increase and effectuate functional use of a paralyzed human hand. It may also be used to overcome stiffness of hand joints and soft tissue caused by trauma or disease. The invention consists of a covering for the hand, typically a glove, that has a plurality of flexion cords and extension cords which are affixed to the fingers of the covering for the hand through a series of openings in the covering for the hand. Attached to one end of the flexion cords and the extension cords are various straps which are holding means for the fingers and which are capable of being attached to a forearm cuff. When the various flexion cords and extension cords are energized by the drawing of the straps, the fingers in the covering for the hand may be positioned in a desired configuration for the assistance of the human hand.

7 Claims, 3 Drawing Sheets

ORTHOPEDIC ASSEMBLY DEVICE TO FUNCTIONALLY ASSIST A DISABLE HUMAN HAND

FIELD OF THE INVENTION

This invention, herein after referred to as the functional assist glove, relates to human hand splinting and/or orthopedic assembly devices used to increase and effectuate functional use of a paralyzed human hand. It may also be used to overcome stiffness of hand joints and soft tissue caused by trauma or disease.

DESCRIPTION OF THE PRIOR ART

Hand splints, such as those shown in U.S. Pat. Nos. 3,903,878 and 4,161,175, are well known and are primarily used to support a limb, particularly when one of the forearm bones is broken. In addition, other splints such as described in U.S. Pat. Nos. 3,938,509 and 4,538,600, are used to correct orthotic conditions or paralytic conditions caused by stroke. These latter corrective splints assist physical and occupational therapists in relieving the effects of a paralyzed hand which tends to turn in towards the wrist and prevents the patient from using his or her fingers. Although the splints set forth in the above indicated patents are effective for treatment of wrist paralyzed patients, a problem frequently occurs in trying to position the paralyzed or injured hand to assist the hand in returning to some functional use.

BACKGROUND OF THE INVENTION

There are several devices available to increase the functional use of a paralyzed or partially paralyzed hand. Virtually all of these devices concentrate on establishing an improved three-jaw pinch (e.g. opposition of the thumb and the first two fingers). The normal method of activation is through wrist extension, but may be achieved in several other ways.

The functional assist glove allows for easy positioning of the fingers and the thumb in several functional ways. The glove cords provide for extension and flexion of the fingers and of the thumb. In this way, functional positions of three-jaw chuck, lateral pinch, and gross grasp can be achieved as the situation requires. The actuation of the cords could be electrical, pneumatic, or through other mechanical means.

Many disabled individuals are understandably adverse to using adaptive equipment to accomplish normal daily activities. The functional assist glove allows the wearer to independently achieve tasks such as eating with normal utensils, brushing teeth, shaving and writing. The functional assist glove is not "normal" in appearance, but does not have the stigma of appearing mechanical in nature, and assists the individual in achieving closer to normal hand function.

Conventional therapeutic wisdom suggests that the fingers of a paralyzed hand be allowed to deform into partial flexion contractures in order to increase the effectiveness of tenodesis action for picking up and manipulating items. The ability of this invention to position the fingers of the hand may reduce the need to allow flexion contractures to form and thereby increase the overall effectiveness and flexibility of the hand. The hand will also have a more normal appearance. When the fingers are placed in flexion by the cords, increased force can be achieved by using the tendonesis action of wrist extension. This invention may still be used effectively, however, even when the wrist is stabilized by conventional means such as an orthoplast splint.

Light dynamic forces or static forces may be achieved without the use of a forearm cuff by anchoring flexion and extension cords to the glove wrist strap.

SUMMARY OF THE INVENTION

In accordance with certain of its objects this invention relates to an orthopedic assembly device to functionally assist a disabled human hand which comprises: a covering for the hand; said covering for the hand has an opening on the ulnar side of the covering; a strap capable of closing the opening and securing said covering for the hand; said covering for the hand has a plurality of fingers and upon said plurality of fingers is a plurality of flexion cord openings capable of receiving flexion cords; said flexion cord openings are positioned on the volar side of the covering for the hand, positioned on the dorsal side of the covering for the hand is a plurality of extension cord openings capable of receiving extension cords; affixed to the fingers of said covering for the hand are flexion cords extending the length of the fingers from distal to proximal, through the flexion cord openings, attached to said flexion cords is a strap capable of holding said fingers in a flexed position; affixed to the fingers of said covering for the hand are extension cords, extending the length of the fingers from distal to proximal, through the extension cord openings, attached to said extension cords is a strap capable of holding the fingers in an extended position; overlapping said covering for the hand is a forearm cuff which provides holding means capable of receiving and holding said straps.

Other object, features and advantages of the invention will become apparent from a consideration of the following detailed description and from the accompanying drawings.

DETAILED DESCRIPTION OF THE INVENTION

Figure 1:
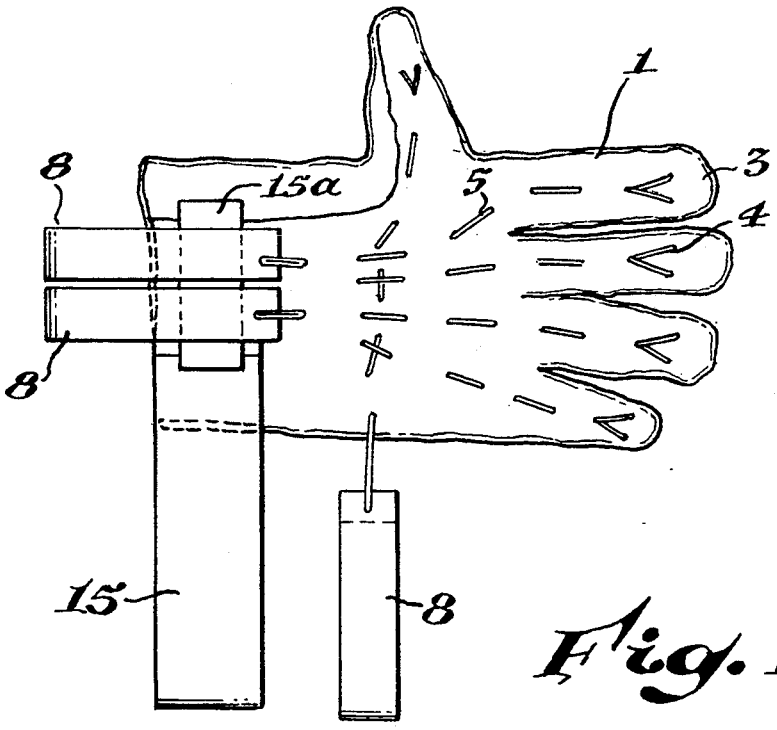
FIG. 1 is a perspective view of the volar (palm) side of the covering of the hand.

Referring more particularly to the drawings FIG. 1 is a perspective view of the volar side of the covering for the hand 1. As shown, the covering for the hand 1 has depicted five fingers 3 and these five fingers 3 have a plurality of openings 4 in the covering for the hand 1 and the fingers 3. These openings 4 are capable of receiving a plurality of flexion cords 5. These flexion cords 5 extend the entire length of the covering for the hand 1 and are affixed to the end of the fingers 3 and to the flexion straps 8. The flexion straps 8 have a surface area of "Velcro-loop" type material affixed thereto. The flexion cords 5 can be made of any material, natural or synthetic, which may be appropriate for these flexion cords 5 to accomplish any type of restraint. The flexion cords 5 may be made of monofilament fishing line, preferred fourteen (14) pound test and 0.14" in diameter. Attached to the covering for the hand 1 is wrist strap 15 and a surface area 15-*a* of wrist strap 15 which is a "Velcro-hook" type material affixed thereto. Wrist strap 15 is adjustable and capable of securely holding the covering for the hand 1 to a human hand. The covering for the hand 1 also has opening 2 permitting and facilitating the ease of placing the covering for the hand 1 over an injured or deformed human hand.

Figure 2:
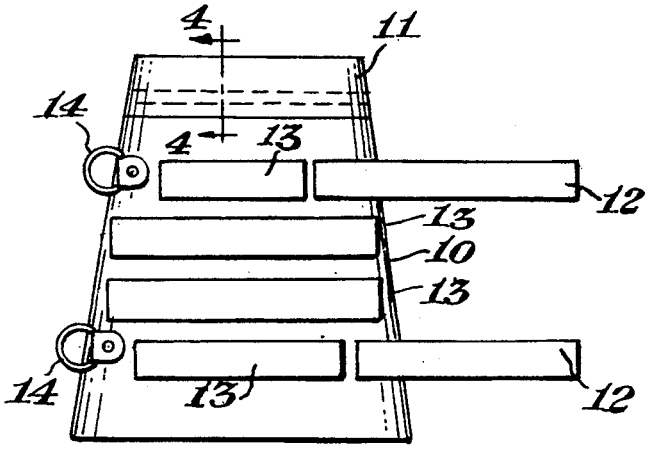
FIG. 2 is a perspective view of the forearm cuff.

Referring now particularly to FIG. 2 which is a perspective view of the forearm cuff 10 which has affixed thereto two or more "Velcro-hook" type straps 13 which are capable of receiving and securely holding flexion cord straps 8 and extension cord straps 9. Holding means 12 again is a securing means that holds firmly the forearm cuff 10 to a human forearm. Holding means 12 has a surface area which is a "Velcro-loop" type material capable of securing the forearm cuff 10. Also, attached to forearm cuff 10 are strap rings 14 which are capable of receiving holding means 12 to safely secure forearm cuff 10 to a human forearm.

Figure 4:
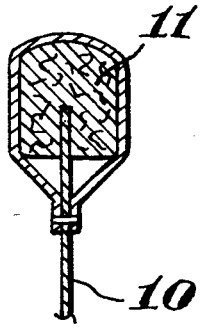
FIG. 4 is a cross sectional view of Line 4—4.

FIG. 4 is a partial view of FIG. 2 at line 4—4 which provides padding 11 for the forearm cuff 10. This padding 11 material may be any type of material, natural or synthetic, which will accomplish this function. This forearm cuff 10 may be physically attached to or made part of the covering for the hand 1.

Figure 3:
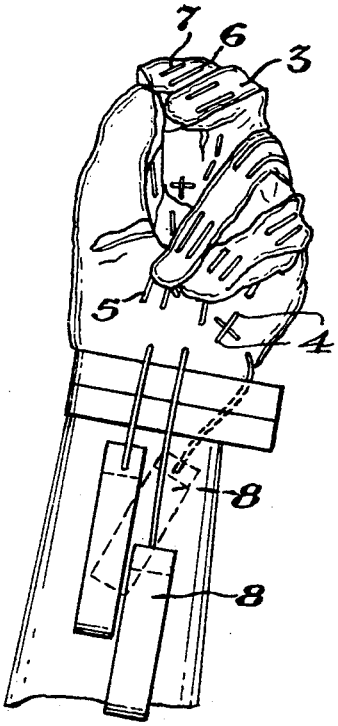
FIG. 3 is a perspective view of the covering for the hand where the fingers are in various degrees of flexion.

As seen in FIG. 3 the fingers 3 are in various degrees of flexion. The various degrees of flexion are accomplished by manually pulling flexion straps 8 towards the forearm cuff 10. The manual pulling of the flexion straps 8 move the flexion cords 5 through the flexion openings 4 which are placed in the fingers 3. Once the desired degree of flexion is achieved in the fingers 3, that degree of flexion is stabilized by affixing the flexion straps 8 to the "Velcro-hook" 13 on the forearm cuff 10. Once the desired stabilized position of the fingers 3 is achieved, various objects such as knives, forks, pencils, fishing rods, etc. can now be firmly held in the fingers 3.

Figure 5:
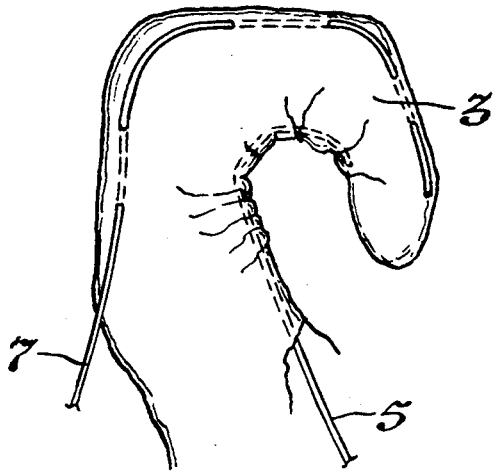
FIG. 5 is a partial view of a finger in flexed position.

As seen in FIG. 5, which is a frag mentated view of finger 3 in a flexion position, wherein, from this view, one can readily see that when flexion cord 5 is pulled, finger 3 is in the selected degree of flexion. Extension cord 7 is in a released position in this view.

Figure 6:
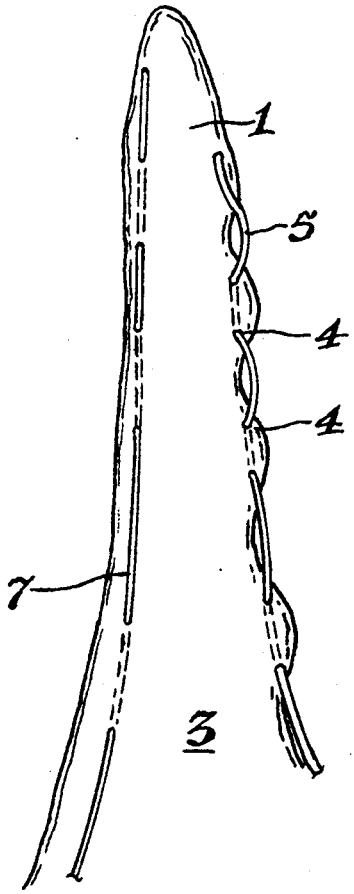
FIG. 6 is a fragmentated view of a finger in an extended position.

FIG. 6 is a fragmentated view of finger 3 which is in an extended position. This position is accomplished by extension cord 7 being pulled by extension straps 9 and thus putting tension on extension cord 7. Flexion cord 5 is in a released position in this view.

Figure 7:
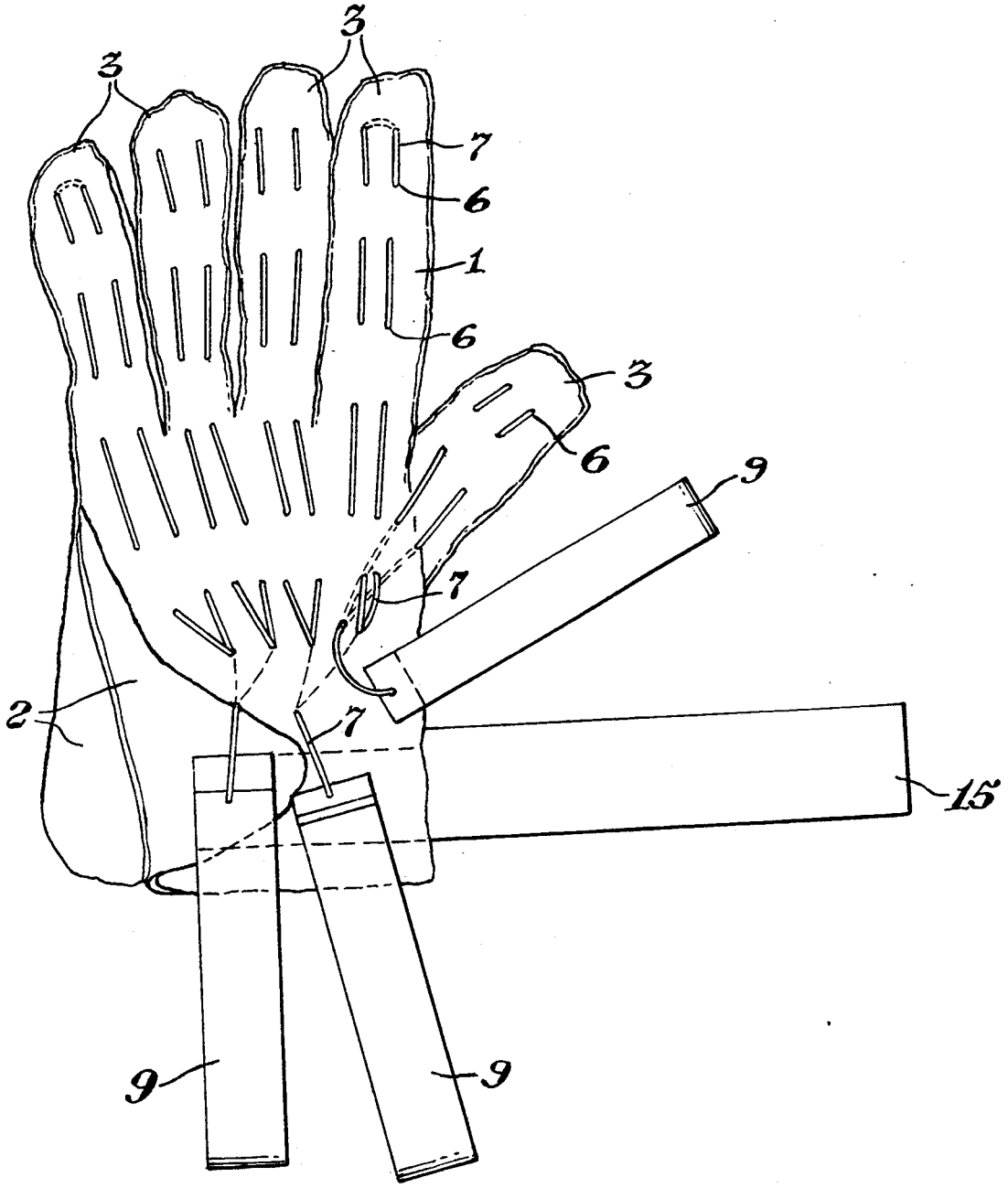
FIG. 7 is a perspective view of dorsal side of the covering for the hand.

FIG. 7 is a perspective view of the dorsal side of the covering for the hand 1 opening 2 of the covering for the hand 1 is shown and this opening 2 assists the user to place, with some ease, the covering for the hand 1 on the user. Extended the full length of the fingers 3 on this the dorsal side of the covering for the hand 1 are a plurality of extension cords 7 which are affixed to the fingers 3 and which are positioned within the covering for the hand 1 through a series of extension cord openings 6 and which are in turn attached to extension cord straps 9 which have a type of "Velcro-loop" surface which are attached to the "Velcro-hook" attaching means 13 on forearm cuff 10. The fingers 3 can be maintained in any degree of extension by merely exerting tension on extension cords 7 and maintaining that tension by securing the extension straps 9 to the forearem cuff 10.

Wrist strap 15 is a "Velcro" type securing means used to secure the covering for the hand 1 around the human hand.

The present invention has been illustrated by the description of the preferred embodiment in considerable detail. It is not the intention of the applicant to restrict or limit the scope of the appended claims to such detail. Additional advantages and modifications will readily appear to those skilled in the art. The invention in its broader aspects is therefore not limited to the specific details, representative apparatus and illustrative examples shown and described. Accordingly, departures may be made from such details without departing from the spirit or scope of applicant's invention.

I claim:

1. An orthopedic assembly device to functionally assist a disabled human hand which comprises: a covering for the hand; said covering for the hand has an opening on the ulnar side of the covering; a wrist strap capable of closing the opening on the ulnar side of the covering and securing said covering for the hand; said covering for the hand has a plurality of fingers and upon said plurality of fingers is a plurality of flexion cord openings capable of receiving non-elastic, flexion cords; said flexion cord openings are positioned on the volar side of the covering for the hand, positioned on the dorsal side of the covering for the hand is a plurality of extension cord openings capable of receiving non-elastic, extension cords; affixed to the fingers of said covering for the hand are non-elastic, flexion cords which are adapted to extend the length of the fingers from distal to proximal, through the flexion cord openings, attached to said non-elastic, flexion cords is a non-elastic, flexion strap capable of holding said fingers in a flexed position; affixed to the fingers of said covering for the hand are non-elastic, extension cords, which are adapted to extend the length of the fingers from distal to proximal, through the extension cord openings, attached to said non-elastic extension cords is a extension strap capable of holding the fingers in an extended position; and overlapping said covering for the hand is a forearm cuff which is adapted to extend around the forearm and provides holding means for the non-elastic flexion strap to position the fingers in a stabilized position to firmly hold and position an object.

2. An orthopedic assembly device to functionally assist a disabled human hand as claimed in claim 1 wherein the flexion cords are capable of being positionally adjusted by flexion cord straps.

3. An orthopedic assembly device to functionally assist a disabled human hand as claimed in claim 1 wherein the extension cords are capable of being positionally adjusted by extension cord straps.

4. An orthopedic assembly device to functionally assist a disabled human hand as claimed in claim 1 wherein the flexion cord straps and the extension cord straps have a fastening means securable, removable and adjustable to the forearm cuff, said fastening means contributing to the selective positioning of the plurality of the fingers.

5. An orthopedic assembly device to functionally assist a disabled human hand as claimed in claim 1 wherein the forearm cuff is attached to and part of the covering for the hand.

6. An orthopedic assembly device to functionally assist disabled human hand as claimed in claim 1 wherein the forearm cuff has fastening means for securely, removably and adjustably fastening the cuff to the forearm, said fastening means contributing to the selective positioning of the plurality of the fingers.

7. An orthopedic assembly device to functionally assist a disabled human hand as claimed in claim 1 wherein the covering for the hand soft, flexible glove.

* * * * *